US012607123B2

(12) United States Patent
Dodds

(10) Patent No.: US 12,607,123 B2
(45) Date of Patent: Apr. 21, 2026

(54) DYNAMIC ROCKBOLT

(71) Applicant: FCI Holdings Delaware, Inc., Wilmington, DE (US)

(72) Inventor: Anthony Dodds, New South Wales (AU)

(73) Assignee: FCI Holdings Delaware, LLC, Wilmington, DE (US)

( * ) Notice: Subject to any disclaimer, the term of this patent is extended or adjusted under 35 U.S.C. 154(b) by 138 days.

(21) Appl. No.: 18/686,084

(22) PCT Filed: Aug. 24, 2022

(86) PCT No.: PCT/IB2022/057912
§ 371 (c)(1),
(2) Date: Feb. 23, 2024

(87) PCT Pub. No.: WO2023/026204
PCT Pub. Date: Mar. 2, 2023

(65) Prior Publication Data

US 2025/0198288 A1 Jun. 19, 2025

(30) Foreign Application Priority Data

Aug. 24, 2021 (AU) ..... 2021221472

(51) Int. Cl.
*E21D 21/00* (2006.01)

(52) U.S. Cl.
CPC ..... *E21D 21/004* (2013.01); *E21D 21/008* (2013.01)

(58) Field of Classification Search
CPC .. E21D 21/004; E21D 21/0033; E21D 21/008
See application file for complete search history.

(56) References Cited

U.S. PATENT DOCUMENTS 3,641,772 A * 2/1972 Dietrich ..... E21D 21/0033 52/704
4,310,266 A * 1/1982 Malsbury ..... E21D 21/004 405/259.1

(Continued)

FOREIGN PATENT DOCUMENTS

AU 2004202519 A1 1/2005
AU 2018226614 A1 7/2019

(Continued)

OTHER PUBLICATIONS

Li, et al. "A review on the performance of conventional and energy-absorbing rockbolts", Journal of Rock Mechanics and Geotechnical Engineering, vol. 6, No. 4, Aug. 1, 2014, pp. 315-327.

*Primary Examiner* — Benjamin F Fiorello
(74) *Attorney, Agent, or Firm* — The Webb Law Firm

(57) ABSTRACT

A friction bolt includes a first tube having an internal diameter and defining a longitudinal split, the tube being radially expandable. The bolt has a first leading or distal end for insertion into a bore and a second or proximal end defining a head and further includes a second tube defining a longitudinal split and having an external diameter which is substantially the same as or larger than the internal diameter of the first tube. The second tube is located inside the first tube with its exterior in contact with the interior of the first tube. The bolt includes a slip and lock mechanism that allows the first or exterior and second or interior tubes to move relative to each other along the longitudinal axis of the friction bolt when a tensile force is applied to the bolt, but to lock together after the force is removed.

15 Claims, 11 Drawing Sheets

(56) References Cited

U.S. PATENT DOCUMENTS

| | | | | |
|---|---|---|---|---|
| 4,490,074 | A * | 12/1984 | Chaiko | E21D 21/0006 405/259.1 |
| 4,696,606 | A * | 9/1987 | Herron | E21D 21/004 72/58 |
| 5,297,900 | A * | 3/1994 | Witzand | E21D 21/004 411/521 |
| 5,882,148 | A | 3/1999 | Mraz | |
| 8,046,964 | B2 | 11/2011 | Zimmer et al. | |
| 8,714,883 | B2 * | 5/2014 | Rataj | E21D 20/003 405/259.4 |
| 10,731,463 | B2 | 8/2020 | Roberts | |
| 2008/0075539 | A1 | 3/2008 | Vosbikian | |
| 2009/0324343 | A1 * | 12/2009 | Eigemann | E21D 21/0093 29/458 |
| 2012/0251262 | A1 * | 10/2012 | Hidalgo Salgado | E21D 21/0033 411/15 |
| 2016/0312610 | A1 | 10/2016 | Moon | |
| 2017/0107815 | A1 | 4/2017 | Rataj et al. | |
| 2024/0376822 | A1 | 11/2024 | Dodds | |

FOREIGN PATENT DOCUMENTS

| | | | |
|---|---|---|---|
| AU | 2021104741 | A4 | 9/2021 |
| CL | 2024000231 | A1 | 8/2024 |
| CN | 102094662 | A | 6/2011 |
| EP | 4377554 | A1 | 6/2024 |
| GB | 1164007 | | 9/1969 |
| KR | 102267049 | B1 | 6/2021 |
| WO | 2011079829 | A2 | 7/2011 |
| WO | 2013173901 | A1 | 11/2013 |
| WO | 2018157198 | A1 | 9/2018 |
| WO | 2023009692 | A1 | 2/2023 |

* cited by examiner

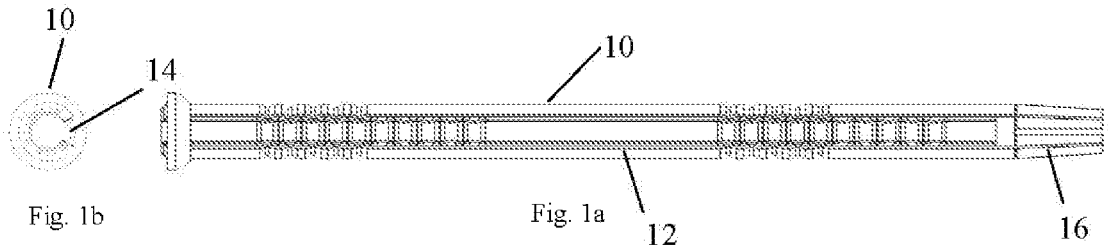
Fig. 1b
Fig. 1a
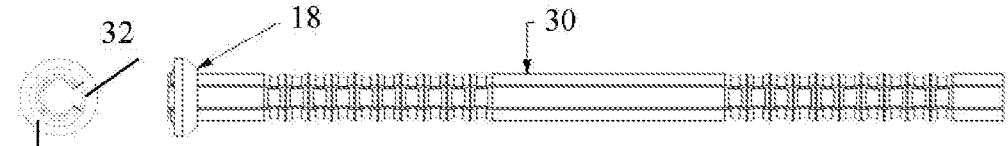
Fig. 2b
Fig. 2a
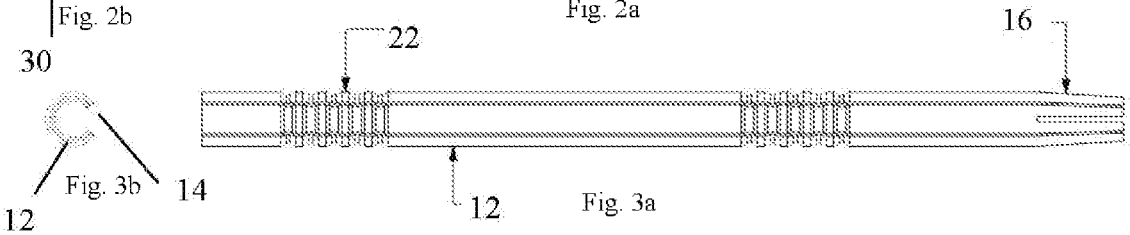
Fig. 3b
Fig. 3a

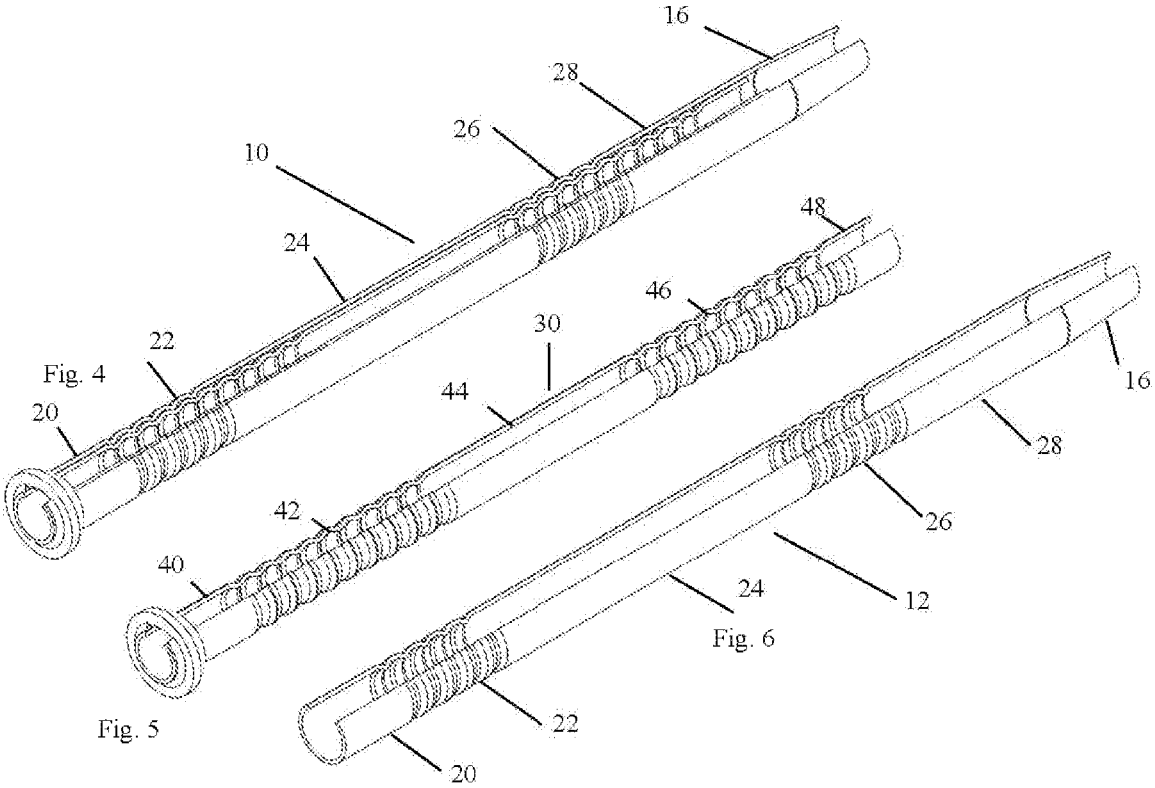
Fig. 4
Fig. 5
Fig. 6
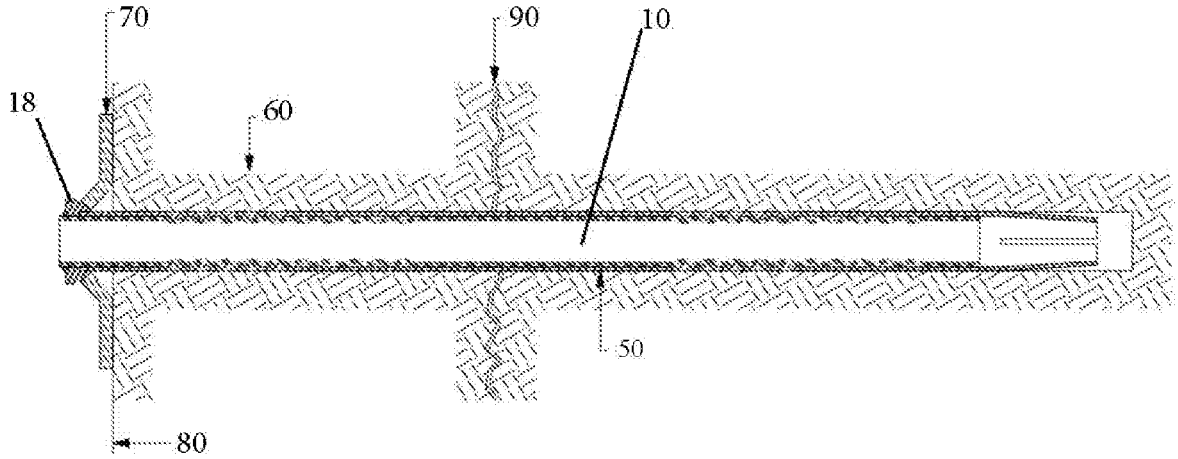
Fig. 7

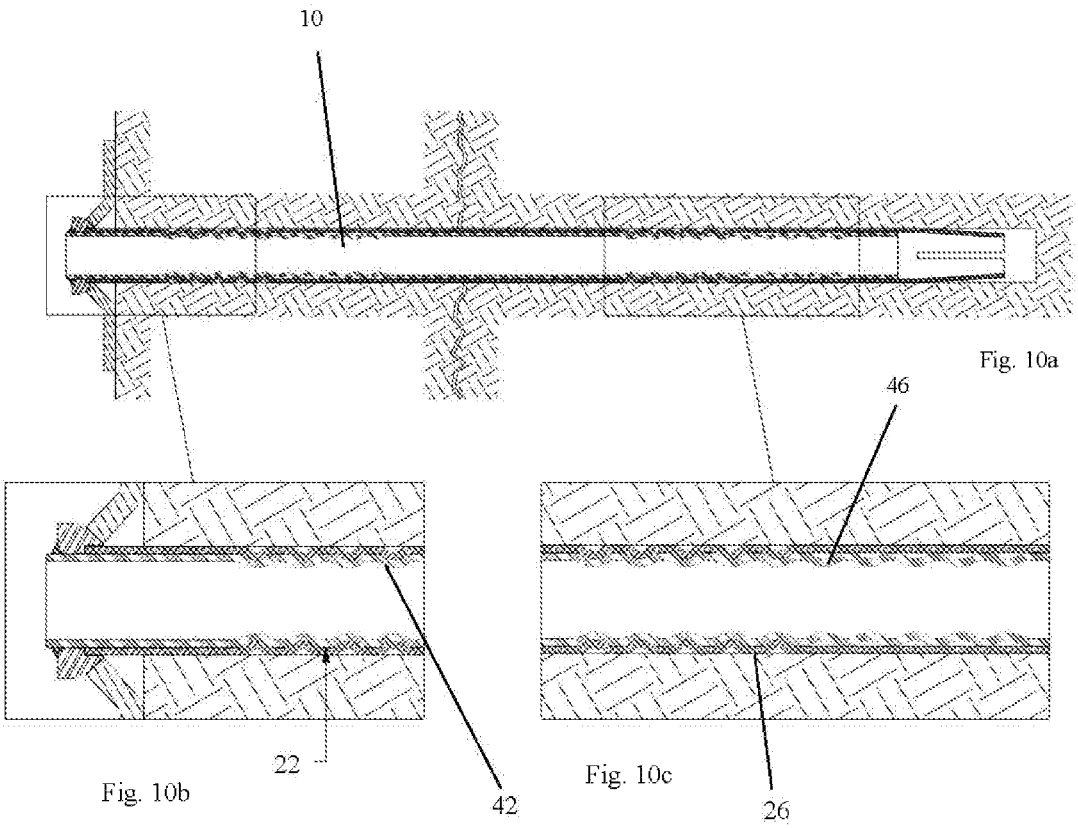
Fig. 10a
Fig. 10b
Fig. 10c
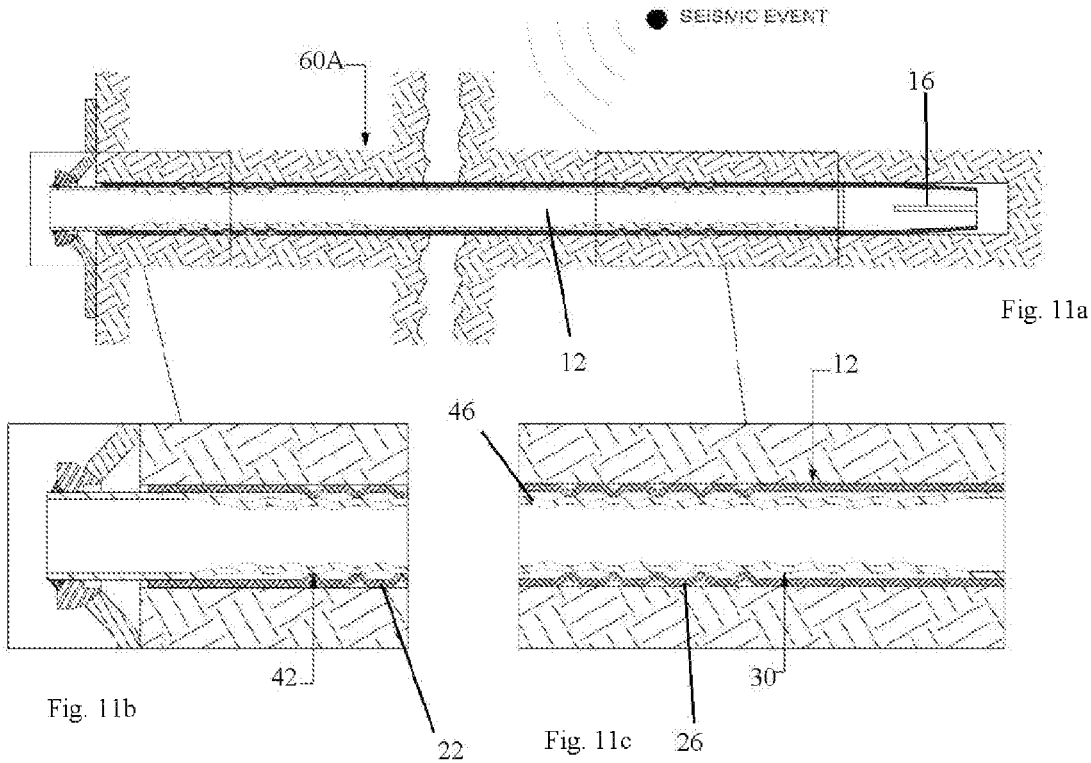
Fig. 11a
Fig. 11b
Fig. 11c

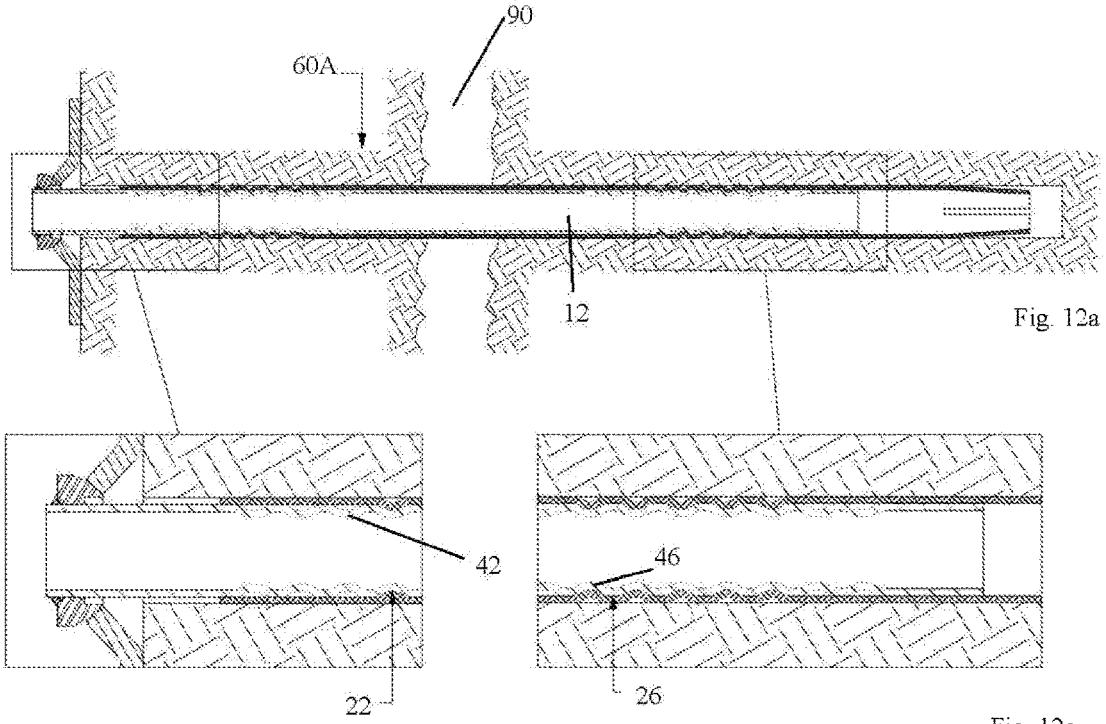
Fig. 12a
Fig. 12b
Fig. 12c
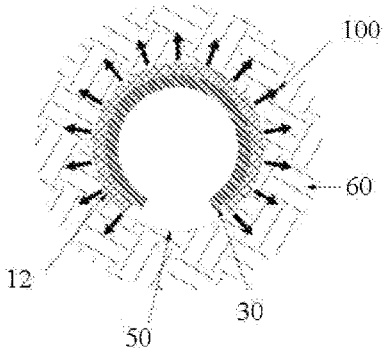
Fig. 13
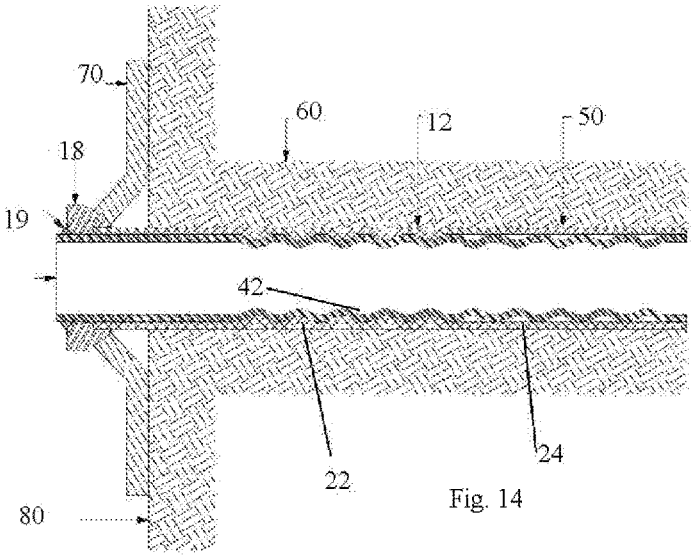
Fig. 14

116
110
114

148
147a
146
145a 132
144
130
145
142
147a
145a
140
18
116
128
126
124

112
122
147
120

DYNAMIC ROCKBOLT

CROSS-REFERENCE TO RELATED APPLICATIONS

This application is the United States national phase of International Patent Application No. PCT/IB2022/057912 filed Aug. 24, 2022, and claims priority to Australian Patent Application No 2021221472 filed Aug. 24, 2021, the disclosures of which are hereby incorporated by reference in their entireties.

BACKGROUND OF THE INVENTION

Field of the Invention

This invention relates to rock bolts and in particular to a friction bolt, also known as friction lock bolts, or split set bolts.

Description of Related Art

Rock bolts are used in rock strata for the purpose of stabilising the strata. One type of rock bolt commonly used in hard rock mines is known as a friction bolt/friction lock bolt. This type of bolt comprises a tube, typically made of steel, that is split longitudinally and which, in use, is forced into a bore, drilled into rock strata which is marginally smaller than the diameter of the tube. The tube becomes elastically compressed and the steel tries to expand and spring back to its original diameter so that the external surface of the tube engages the internal surface of the bore, anchoring the rock bolt inside the bore by friction forces.

Friction bolts are relatively cheap to manufacture and are easy to use compared with some other types of rock bolts which often require resin or cement to lock them into the bore. However, friction bolts do have a number of drawbacks. One significant drawback is the tendency for friction bolts to slip from the bore when a sufficiently large force is applied to the bolt. Also these types of bolts are not suitable for use in dynamic ground conditions as they have a very low capacity for absorbing energy.

In recent years there has been an increasing demand for friction bolts which are resistant to larger pull out forces and have the capacity to resist higher pull out forces/loads. However, even the improved pull out strengths of these newer designs of friction bolts do not provide a dynamic response which is required in ground conditions which are unstable and/or prone to high stress and rock bursts.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY OF THE INVENTION

In a first broad aspect, the present invention provides a friction bolt comprising an elongate exterior tube and at least one elongate interior tube located inside the exterior tube wherein the tubes are connected and movement of the interior tube relative to the exterior tube occurs when a sufficient force is applied to the friction bolt and wherein the relative movement of the exterior tube and interior tube dissipates energy.

The invention also provides friction bolt including a first elongate tube having an internal diameter and defining a longitudinal split, the tube being radially expandable, the bolt having a first leading or distal end for insertion into a bore and a second or proximal end defining a head and further including a second elongate tube defining a longitudinal split and having an external diameter which is substantially the same as or larger than the internal diameter of the first tube located inside the first tube with its exterior in contact with the interior of the first tube and wherein the bolt includes a slip and lock mechanism that allows the second or interior and first or exterior tubes to move relative to each other along the longitudinal axis of the friction bolt when a tensile force is applied to the bolt, but to lock together after the force is removed.

The second tube will preferably be at least about half the length of the first tube, more preferably between half the length of the first tube and the full length of the first tube, more typically will be at least 90% of and more preferably approximately the same length as the first tube. Its length can vary from 1 to 5 m depending on the particular application, and the length of the first tube, but is typically around 1.5 to 2.5 m, more typically about 2 m in length.

Typically the first and second tubes will be generally circular in cross-section to conform to the generally circular borehole typically drilled in the rock. As used herein "enerally circular" is intended to encompass any cross-sections which fit inside such a borehole. Although circular tubes are preferred, some non-circular cross-sections which are possible includes polygons such as octagons, and sections additional elements welded or attached to them.

The slip and lock mechanism may include formations or deformations on one or both of the first and second tubes which interlock the tubes together but which can disengage and allow the tubes to slide relative to one another under longitudinal tension.

The formations or deformations on one or both of the first and second tubes may comprise overlapping radial crimps or corrugations on the first and second tubes, the corrugations defining a series of ribs and grooves with the ribs of the corrugations of the first tube nesting in the grooves of the corrugations of the second tube.

Preferably, the corrugations of the second or interior tube extend further along the tube than the corrugations of the first tube so that they are overlapped by both a corrugated section of the first tube and an un-corrugated part cylindrical section defining a smooth outer surface.

In one preferred embodiment, the interior and exterior tubes define two overlapping corrugated sections, one near or towards the proximal end of the friction bolt and one near or towards the distal end of the friction bolt.

In a preferred embodiment, the proximal end which engages with a bearing plate or the like is defined on one tube and the distal tapered end of the friction bolt is defined on the other tube. In one embodiment the proximal end of the inner tube defines a ring for engagement with a bearing plate or the like and the distal end of the exterior tube is tapered for insertion into a bore.

Although forming radial crimps or undulations in the exterior tube with matching crimps in the interior tube which can interlock but also slide over each other when sufficient force is applied to ratchet the tubes apart is one preferred slip and lock mechanism, other means to interlock the exterior and interior tubes while allowing energy dissipation due to relative movement of the tubes are possible. Among the options envisaged is the use of adhesives, tack welds between the two elements which break when a particular tensile force is applied, or other connections which absorb energy before breaking or stretching.

Thus in one embodiment the undulations can be provided by a material additive process such as welding, rather than crimping in which ribs are formed on the exterior to the inner tube and the interior of the outer tube.

Typically, the formations on one or both of the first and second tubes comprise overlapping spaced ribs formed on the first and second tubes, the ribs of the first tube nesting in spaces between the ribs of the second tube.

The ribs may be formed on the exterior of the second tube by welding or other additive manufacturing process and the ribs may be also formed on the interior of the first tube by welding or other additive manufacturing process.

The ribs are separated by spaces which are typically from 1 to 5 times the diameter of the ribs.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF THE DRAWINGS

The terms FIG., FIGS., Figure, and Figures are used interchangeably in the specification to refer to the corresponding figures in the drawings.

Specific embodiments of the present invention will now be described, by way of example only, and with reference to the accompanying drawings in which:—

FIGS. 1*a* and 1*b* show a side view and an end view of a first embodiment of a friction bolt;

FIGS. 2*a* and 2*b* show a side view and an end view of the interior tube of the friction bolt shown in FIG. 1;

FIGS. 3*a* and 3*b* show a side view and an end view of the exterior tube of the friction bolt shown in FIG. 1;

FIG. 4 shows an isometric view of the friction bolt shown in FIG. 1;

FIG. 5 shows an isometric view of the interior tube of the friction bolt shown in FIG. 1;

FIG. 6 shows an isometric view of the exterior tube of the friction bolt shown in FIG. 1;

FIG. 7 is a side view illustrating the friction bolt installed in rock in which there is a discontinuity before a dynamic event;

FIG. 10*a* repeats FIG. 7 and FIGS. 10*b* and 10*c* are detailed views of the friction bolt installed in rock before a dynamic event;

FIG. 11*a* repeats FIG. 8*a* and FIGS. 11*b* and 11*c* are detailed views of the friction bolt installed in rock during a dynamic event;

FIG. 12*a* repeats FIG. 9*a* and FIGS. 12*b* and 12*c* are detailed views of the friction bolt installed in rock after a dynamic event;

FIG. 13 is a sectional view illustrating the principals of operation of the friction bolt;

FIG. 14 shows a close up of the proximal end of the friction bolt of FIG. 1 installed in rock, prior to a dynamic event.

DESCRIPTION OF THE INVENTION

Figure 8A:
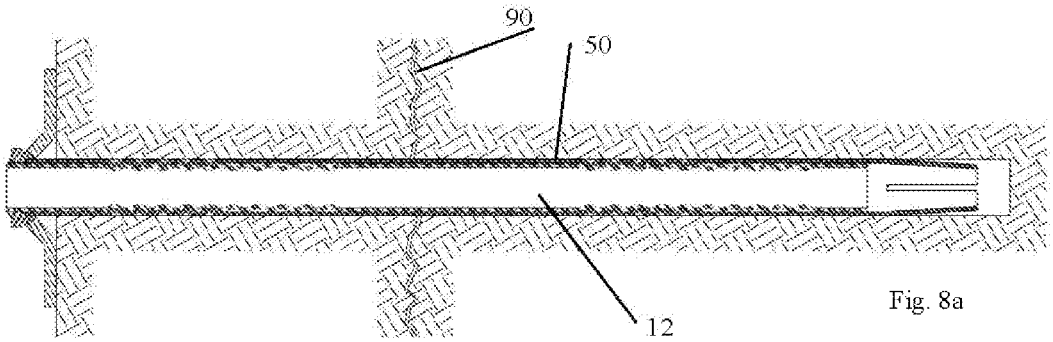
FIGS. 8*a* and 8*b* illustrate the friction bolt installed in rock in which there is a discontinuity during a dynamic event.
Figure 8B:
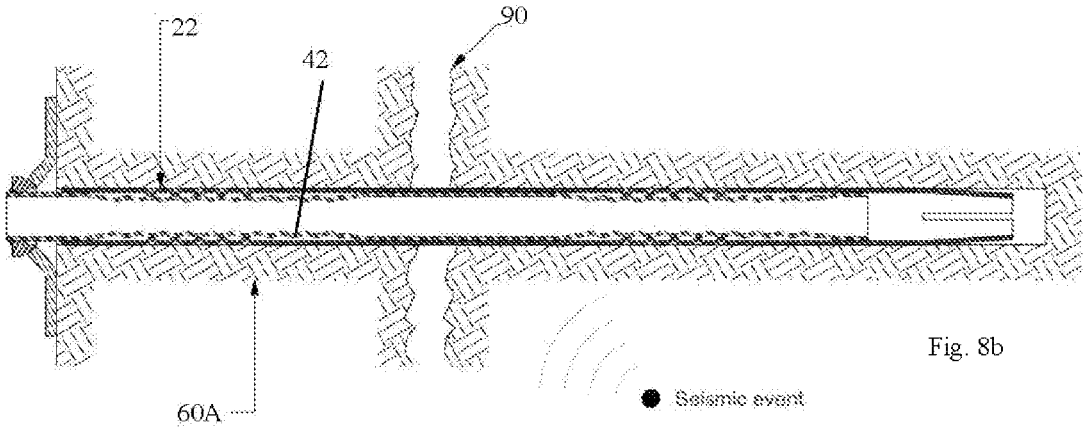
Figure 9A:
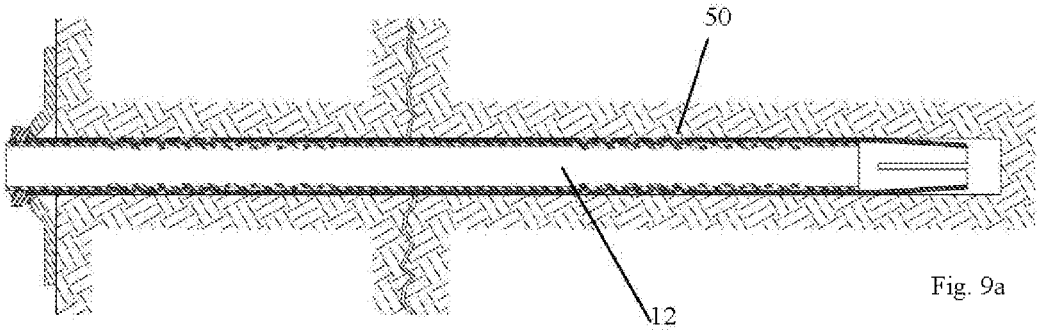
FIGS. 9*a* and 9*b* illustrate the friction bolt installed in rock in which there is a discontinuity after a dynamic event.
Figure 9B:
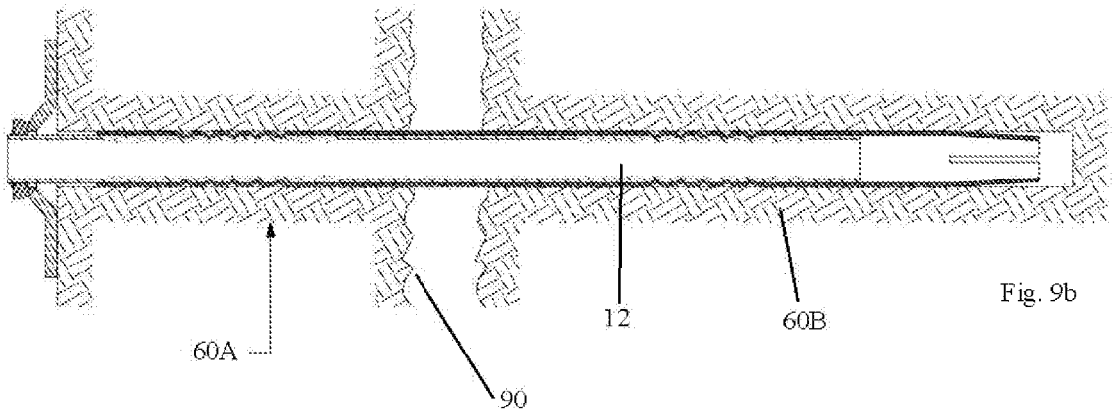

Referring to the drawings, FIGS. 1 to 6 illustrate a friction bolt 10 embodying the present invention. The friction bolt 10 includes a first elongate outer or exterior tube 12 made of steel shown separately in FIGS. 3*a*, 3*b* and 6. The friction bolt 10 is typically in the order of 2 m long, but its length can vary from 1 to 5 m depending on the particular application. The tube 12 is generally cylindrical but is split longitudinally along its length. The split 14 extends along the length of the tube. The tube 12 tapers at the leading end 16 of the bolt. The tapered end 16 makes it easier to insert the tube into a pre-drilled bore.

A second, inner or interior tube 30, also made of steel, and best seen in FIGS. 2*a* and 2*b* and 5, is located inside the split tube 12 and extends for substantially almost the full length of the tube 12 from the proximal end as far as the start of the leading end 16 where the tube begins to narrow and taper. The second tube being substantially the same length as the first tube is also typically in the order of 2 m long, but its length can vary from 1 to 5 m depending on the particular application, and the length of the first tube. The interior tube 30 is, like the exterior tube 12, also a generally cylindrical tube which defines a longitudinal split 32. As shown in FIG. 2*b*, the split 32 subtends an angle of about 60° to 70° although the size of the split may vary. As can be seen from FIG. 1*b*, the splits in the tube 12 and the insert 30 are aligned/coincident in the friction bolt 10, although the splits do not have to be aligned, or even overlap with each other, and may be offset or rotated relative to one another With reference to FIGS. 2*a* and 5 in particular, it can be seen that a domed ring 18 attached to the proximal end of the interior tube 30 by a weld 19 (best seen in FIG. 14).

The interior tube 30 has a first portion 40 having a part-circular cross section, a second portion 42 where the part-circular tube has been radially crimped or corrugated to define a series of ribs separated by grooves, a third portion 44 having a part-circular cross section a fourth portion 46 where the part-circular tube has also been crimped or corrugated and a final end portion 48 having a part-circular cross section defining the distal end of the interior tube 30. As is explained in more detail below, the deformations or formations in the form of the overlapping corrugated portions provide a slip and lock mechanism that allows the interior and exterior tubes to move relative to each other when under a dynamic force, typically tension, but to lock together after the force is removed.

The exterior tube 12 shown in FIGS. 3*a* and 6 has a first portion 20 having a part-circular cross section, a second portion 22 where the part-circular tube has been crimped or corrugated, which is approximately half the length of the correspondingly located corrugated portion 42 of the interior tube, a third portion 24 having a part-circular cross section a fourth portion 26 where the part-circular tube has been crimped or corrugated which is approximately half the length of the correspondingly located portion 46 in the interior tube, a fifth portion 28 having a part-circular cross section and the final tapered section 16 defining the distal end of the friction bolt 12.

Figure 15:
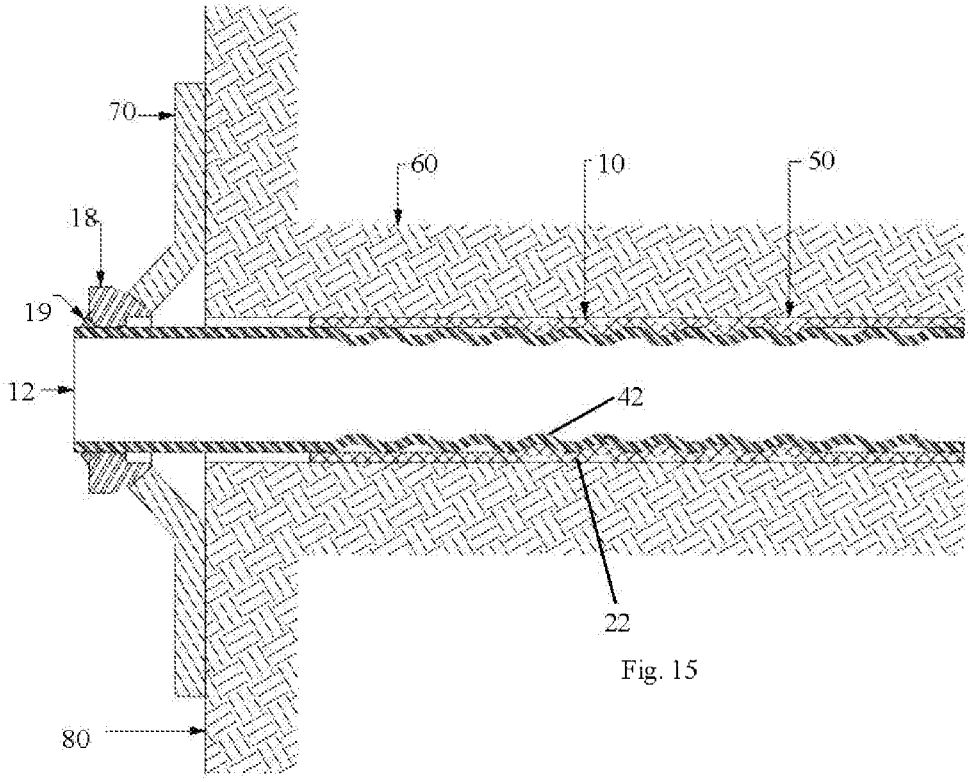
FIG. 15 shows a close up of the proximal end of the friction bolt of FIG. 1 installed in rock, after a dynamic event.

With reference to FIGS. 1 to 6, and also to FIGS. 14 and 15, when the tubes are assembled as shown in FIG. 1*a*, the corrugated portion 22 of the exterior tube overlaps the equivalent portion 42 of the interior tube from the start of the portion to about its middle. The rest of the corrugated portion 22 is overlapped by the first part of smooth part-circular portion 24. As is best seen in FIG. 14, the shape, amplitude and spacing of the ribs and grooves of the undulations in the exterior and interior tubes are the same so that the corrugated portions 42 and 46 nest within the corresponding portions 22 and 26 where they coincide.

The external diameter of the insert is the about same size or possibly slightly larger than the internal diameter of the friction bolt tube 12 so that it contacts the interior of the split tube 12 as shown in FIG. 14.

Advantageously, the installation procedure is the same as for a standard friction bolt. FIG. 7 shows the friction bolt 10 installed into rock 60. In a first stage, a borehole 50 is drilled into the rock 60. The diameter of the borehole 50 is slightly less than the external diameter of the friction bolt 10. The friction bolt 10, is inserted through a bearing plate 70 facing the excavation face 80, into the pre-drilled borehole 50 typically using percussive force to hammer the friction bolt 10 into the borehole. Once the friction bolt 10 is fully inserted the domed head 18 abuts the bearing plate 70 located over the entry to the borehole. In FIG. 7 it can also be seen that there is a discontinuity 90 in the rock.

FIGS. 8*a* to 15 illustrate aspects of the operation of the friction bolt 10 during a dynamic/seismic event in which the discontinuity 90 widens causing a separation in the rock 60 which splits into two parts 60A and 60B, either side of the discontinuity 90.

FIGS. 7, FIGS. 10*a* to 10*c* show the friction bolt 10 installed and prior to a dynamic event. FIGS. 8*a* and 8*b* and FIGS. 11*a* to 11*c* show the friction bolt during a dynamic event. FIGS. 9*a* and 9*b* and FIGS. 12*a* to 12*c* show the friction bolt after a dynamic event.

FIGS. 7 and 10*a* to 10*c* and FIG. 14 show the friction bolt 10 before the dynamic event in which the ribs of the interior tube and the ribs of the exterior tube interlock and nest within one another in both ribbed sections of the bolt, as is best seen in FIGS. 10*b* and 10*c* respectively.

Turning to FIGS. 8*a* and 8*b* and FIGS. 11*a* to 11*c*, during the seismic event, as shown in FIGS. 11*b* and 11*c*, as the rock mass 60A moves in the excavated area (to the left as oriented in the drawings) the interior tube 30 moves relative to the exterior tube 12 and the ribs of the interior tube ride over the ribs of the exterior tube. This dissipates energy as the tube is, typically elastically, deformed during this ratcheting process, as well as lengthening the friction bolt to cope with the movement of the rock mass 60A. During the seismic event, the exterior tube 12 remains fixed to the bore in the main rock mass 60B and does not move.

In more detail, the separation applies a tensile force to the friction bolt stretching it which causes the interior tube 30 and exterior tube 12 to move relative to each other and the corrugated sections 22 and 42, and 26 and 46 to move or ratchet over each other allowing the friction bolt 10 to lengthen while dissipating energy. In this process the split 32 in the interior tube 30 will close slightly as the corrugated sections 42 and 46 of the inner tube 30 become further compressed and the deformation allows the ribs in the interior tube and exterior tube to move past each other. The front part of the rock mass 60A tends to move forwards into the tunnel/excavation or the like and drags the interior tube 12 with it. The friction bolt 10 lengthens and allows the forward movement of the rock 60A but once the event has ended, the ribs of the interior tube 30 and exterior tube 12 re-engage and the integrity of the friction bolt remains and the rock mass 60A is safely immobilised. With reference to FIGS. 11*c* and 11*b*, the outer tube 12 remains fixed to the wall of the bore 50 in the rock 60B. The inner tube moves to the left as oriented in the drawings. The ribs of the corrugated section 42 of the interior tube rise over the ribs of the corrugated section 22 of the exterior tube. Likewise ribs of the corrugated section 46 of the interior tube rise over the ribs of the corrugated section 26 of the exterior tube.

With reference to FIGS. 12*a* to 12*c* and FIG. 15 in particular it can be seen that after the dynamic event has concluded, the ribs of the interior tube re-engage with the adjacent ribs of the exterior tube. The outer tube 12 is shown to have slid down the bore and have moved relative to the domed section which is welded to the interior tube 30 and the bearing plate which remain held in place by the domed ring 18. As can be seen the corrugated portion 22 of the exterior tube is still engaged with the corrugated portion 42 of the interior tube but is now engaged towards the middle of the corrugated portion 42. Likewise the corrugated portion 26 of the distal end of the exterior tube is still engaged with the corrugated portion 46 of the interior tube but is now engaged towards the middle of the corrugated portion 46.

FIG. 13 is a sectional view illustrating the principals of operation of the friction bolt in which radial pressure caused by the insertion of the friction bolt 10 into a bore hole 50 which is smaller than the outside diameter of the exterior tube 12 of the friction bolt elastically compresses the tube and causes radial pressure on the walls of the bore indicated by the arrows 100 creating frictional resistance to removal of the fiction bolt 10.

Figure 16:
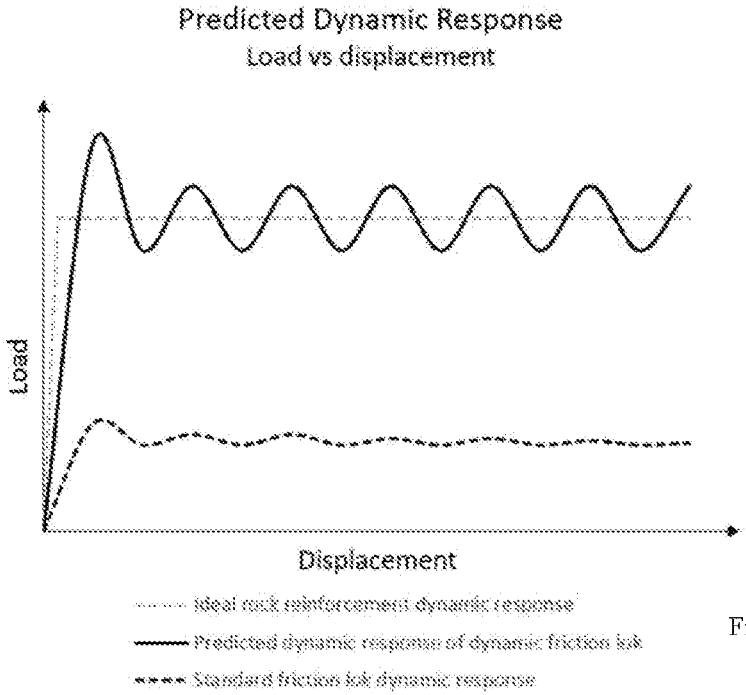
FIG. 16 is a graph illustrating the predicted dynamic response of the friction bolt.

FIG. 16 is a graph of load versus displacement illustrating the predicted dynamic response of the friction bolt. The graph compares an ideal rock reinforcement dynamic response with both a typical standard friction bolt dynamic response and a predicted response from the friction bolt 10, which is greatly superior to the standard friction bolt and close to the ideal response.

Although the described embodiment provides two overlapping corrugated sections in the friction bolt it will be understood that some embodiments may include just one overlapping section or may include three or more overlapping corrugated sections. The size, number, and depth of the corrugations/radial crimps may be varied to provide different performance in terms of shear and energy absorption depending on ground conditions and engineering requirements.

Other types of mating deformations may be provided in the interior and exterior tube which allow the tubes to move/slip relative to each other during a dynamic event and lock together after the dynamic event has ceased.

Figures 17, 18, 19:
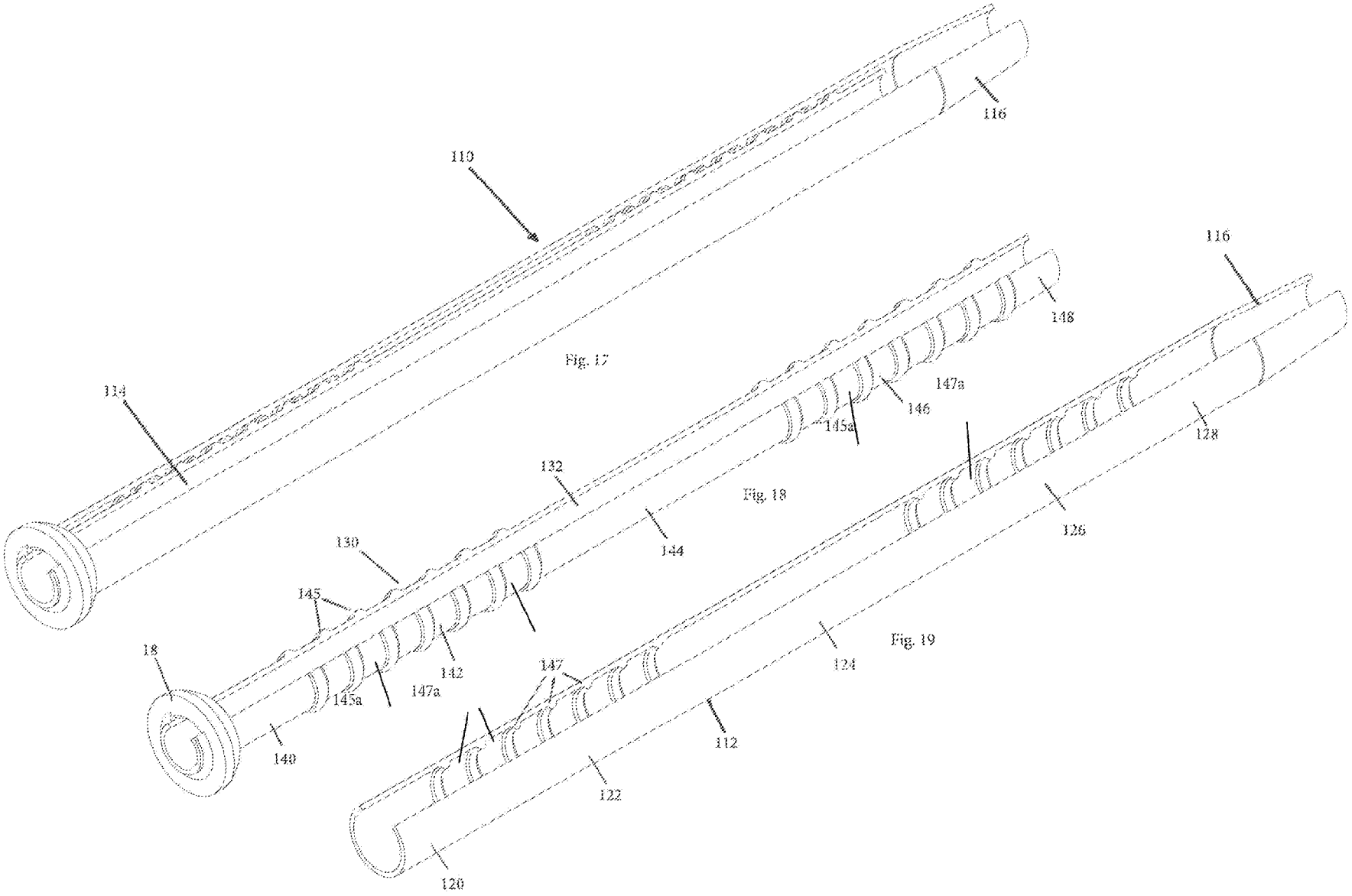
FIG. 17 is an isometric view of a second embodiment of a friction bolt.
FIG. 18 is an isometric view of an inner tube of the second embodiment of friction bolt shown in FIG. 17.
FIG. 19 is an isometric view of an outer tube of the second embodiment of friction bolt shown in FIG. 17.

FIGS. 17 to 19 show a second embodiment 110 of a friction tube. The friction bolt 110 is almost identical to the first embodiment and the main difference between the two is that instead of radial crimps being formed to create the slip and lock mechanism, welded ribs are formed between the inner and outer tubes. In particular, the friction tube 110 includes a first elongate outer or exterior tube 112 made of steel shown separately in FIG. 19. The friction bolt 110 is typically in the order of 2 m long, but its length can vary from 1 to 5 m, depending on the particular application. The tube 112 is generally cylindrical but is split longitudinally along its length. The split 114 extends along the length of the tube. The tube 112 tapers at the leading end 116 of the bolt. The tapered end 116 makes it easier to insert the tube into a pre-drilled bore.

A second, inner or interior tube 130, also made of steel, and best seen in FIG. 18 is located inside the outer tube 112 and extends for substantially almost the full length of the tube 112 from the proximal end as far as the start of the leading end 116 where the tube begins to narrow and taper. The second tube being substantially the same length as the first tube is also typically in the order of 2 m long, but its length can vary from 1 to 5 m depending on the particular application, and the length of the first tube. The interior tube 130 is, like the exterior tube 112, also a generally cylindrical tube which defines a longitudinal split 132. The split 132 subtends an angle of about 60° to 70° although the size of the split may vary. The splits in the tube 112 and the insert 130 are aligned/coincident in the friction bolt 110, although the splits do not have to be aligned, or even overlap with each other and may be offset or rotated relative to one another With reference to FIG. 18, a domed ring 18 attached to the proximal end of the interior tube 130 by a weld.

The interior tube 130 has a first portion 140 having a part-circular cross section, a second portion 142 where the part-circular tube has had a series of seven spaced part-annular ribs 145 formed on and extending around the exterior of the tube by welding or other additive process, a third portion 144 having a part-circular cross section a fourth portion 146 where again the part-circular tube has had a series of seven spaced part-annular ribs 145 formed on the exterior of the tube by welding and a final end portion 148 having a part-circular cross section defining the distal end of the interior tube 130. The ribs 145 are separated by gaps or spaces 145*a* which are several times the diameter of the rib.

The exterior tube 112 shown in FIG. 19 has a first portion 120 having a part-circular cross section, a second portion 122 where the part-circular tube has had a series of part-annular spaced ribs 147 formed on and extending around the interior of the tube by welding or other additive process, a third portion 124 having a part-circular cross section a fourth portion 126, where the part-circular tube has had a further series of spaced part-annular ribs 147 formed on the interior of the tube by welding or another suitable additive process, a fifth portion 128 having a part-circular cross section and the final tapered section 116 defining the distal end of the friction bolt 112. The ribs 147 are separated by gaps or spaces 147*a* which are several times the diameter of the rib.

With reference to FIGS. 17 to 22*b*, when the tubes are assembled as shown in FIG. 17, the ribbed portions of the exterior tube overlap the equivalent ribbed portions of the interior tube.

Figure 20:
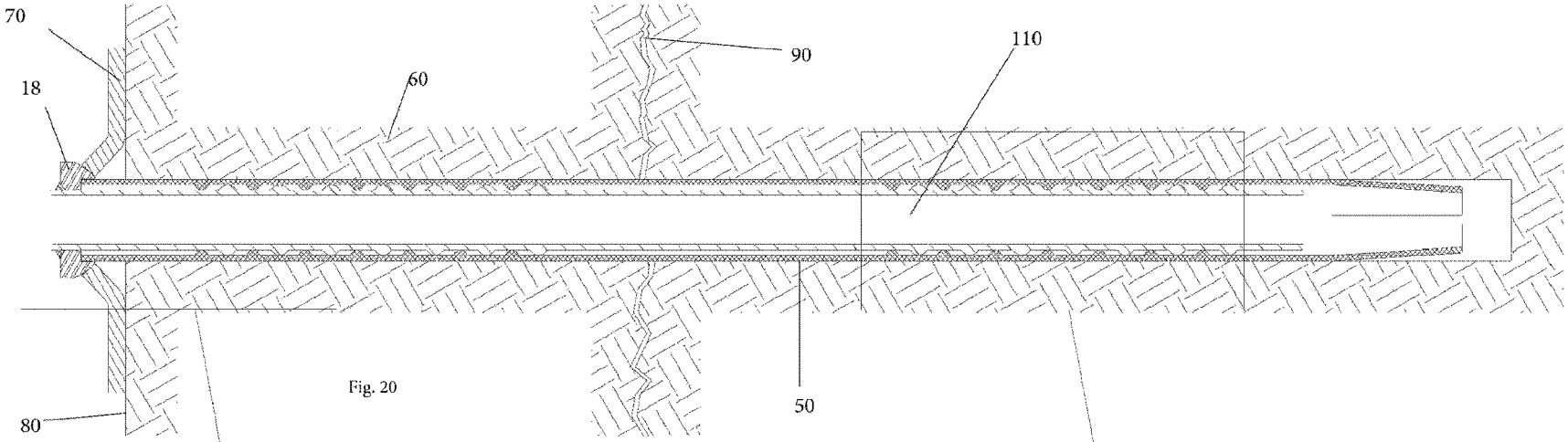
FIGS. 20, 20*a* and 20*b* illustrate the second embodiment installed in rock prior to a seismic event.
Figure 20B:
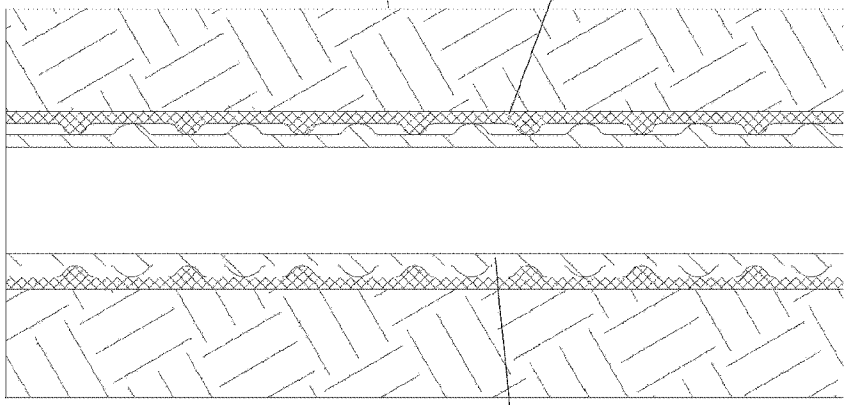

Advantageously, the installation procedure is the same as for a standard friction bolt. FIGS. 20 to 20*b* show the friction bolt 110 installed into rock 60. In a first stage, a borehole 50 is drilled into the rock 60. The diameter of the borehole 50 is slightly less than the external diameter of the friction bolt 110. The friction bolt 110, is inserted through a bearing plate 70 facing the excavation face 80, into the pre-drilled borehole 50 typically using percussive force to hammer the friction bolt 110 into the borehole. Once the friction bolt 110 is fully inserted the domed head 18 abuts the bearing plate 70 located over the entry to the borehole. In FIG. 20 it can also be seen that there is a discontinuity 90 in the rock.

FIGS. 20*a* to 22*b* illustrate aspects of the operation of the friction bolt 110 during a dynamic/seismic event in which the discontinuity 90 widens causing a separation in the rock 60 which splits into two parts 60A and 60B, either side of the discontinuity 90.

Figures 21, 21A, 21B:
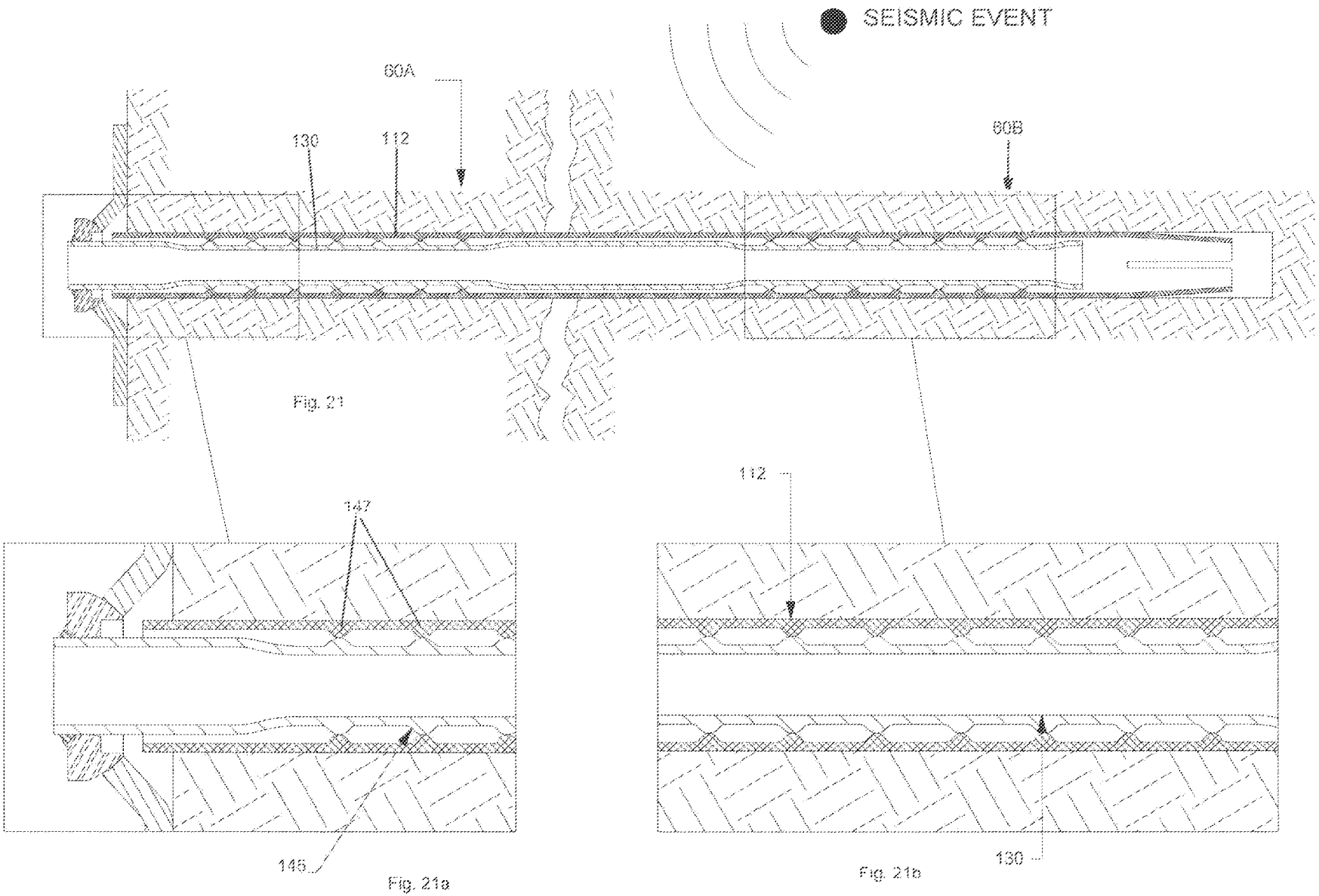
FIGS. 21, 21*a* and 21*b* illustrate the second embodiment installed in rock during a seismic event.
Figure 22:
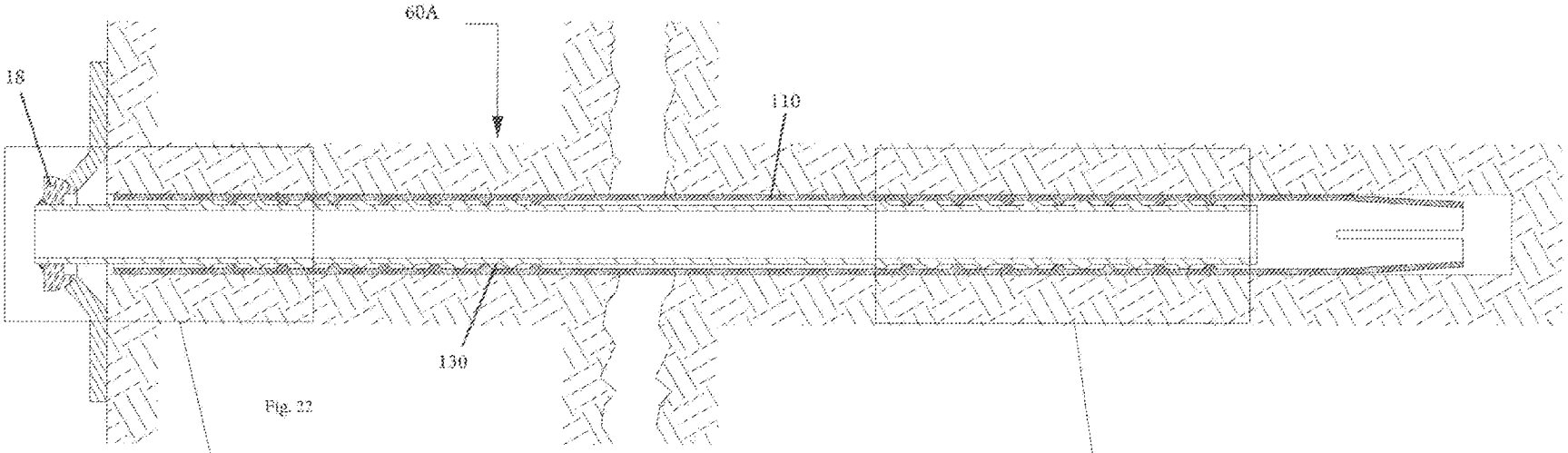
FIGS. 22, 22*a* and 22*b* illustrate the second embodiment installed in rock after a seismic event.
Figure 22B:
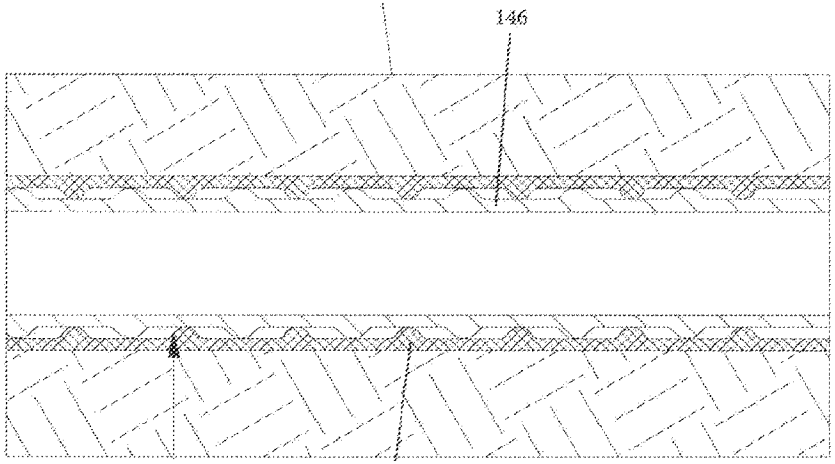
Figure 22A:
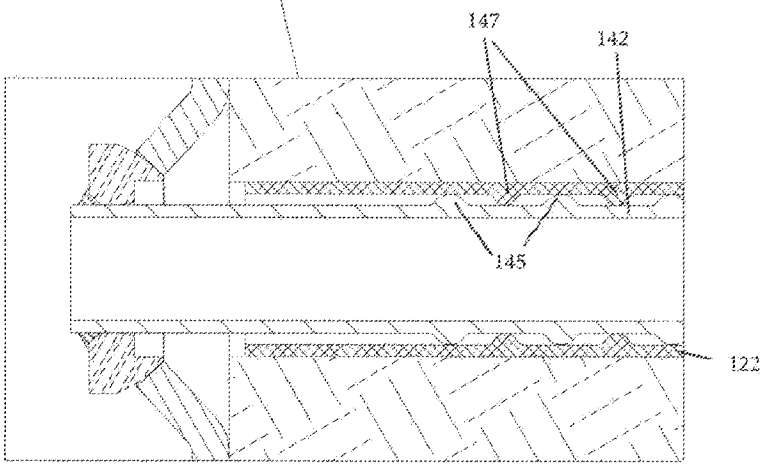

FIGS. 20 to 20*b* show the friction bolt 110 installed and prior to a dynamic event. FIGS. 21 to 21*b* show the friction bolt during a dynamic event. FIGS. 22 to 22*b* show the friction bolt after a dynamic event.

Figure 20A:
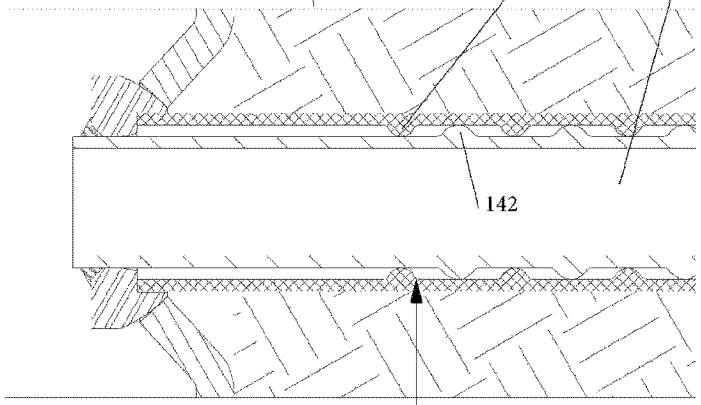

FIGS. 20 to 20*b* show the friction bolt 110 before the dynamic event in which the ribs 147 of the interior tube 130 locate in spaces 145*a* between the spaced ribs 145 of the exterior tube. Likewise, the ribs 145 of the exterior tube locate in spaces 147*a* between the ribs 147 of the exterior tube. Thus the ribs interlock and nest within one another in both sections 142/122 and 126/146 of the bolt, as is best seen in FIGS. 20*a* and 20*b* respectively. Slight relative movement of the inner and outer tube is possible without the ribs 145/147 riding over each other.

Turning to FIGS. 21 to 21*b*, during the seismic event, as the rock mass 60A moves in the excavated area (to the left as oriented in the drawings) the interior tube 130 moves relative to the exterior tube 112 and the ribs 145 of the interior tube ride over the ribs 147 of the exterior tube. This dissipates energy as the tube is, typically elastically, deformed during this ratcheting process, as well as lengthening the friction bolt to cope with the movement of the rock mass 60A. During the seismic event, the exterior tube 112 remains fixed to the bore in the main rock mass 60B and does not move.

In more detail, the separation applies a tensile force to the friction bolt stretching it which causes the interior tube 130 and exterior tube 112 to move relative to each other and the ribbed sections 122 and 142, and 126 and 146 to move or ratchet over each other allowing the friction bolt 110 to lengthen while dissipating energy. In this process the split 132 in the interior tube 130 will close slightly as the ribbed sections 142 and 146 of the inner tube 130 become further compressed and the deformation allows the ribs 145/147 in the interior tube and in the exterior tube to move past each other. The front part of the rock mass 60A tends to move forwards into the tunnel/excavation or the like and drags the interior tube 112 with it. The friction bolt 110 lengthens and allows the forward movement of the rock 60A but once the event has ended, the ribs of the interior tube 130 and exterior tube 112 relocate in the spaces 145*a* and 147 a and the integrity of the friction bolt remains and the rock mass 60A is safely immobilised.

With reference to FIGS. 22 to 22*b* it can be seen that after the dynamic event has concluded, the ribs 145 of the interior tube re-engage in the spaces 147*a* between the adjacent ribs 147 of the exterior tube. The outer tube 112 is shown to have slid down the bore and have moved relative to the domed section 18 which is welded to the interior tube 130 and the bearing plate 70 which remain held in place by the domed ring 18. As can be seen the ribbed portion 122 of the exterior tube is still engaged with the ribbed portion 142 of the interior tube but the ribs 145 have moved one space 147*a* to the left. Likewise the corrugated portion 126 of the distal end of the exterior tube is still engaged with the corrugated portion 146 of the interior tube but the ribs 145 have moved one space 147*a* to the left.

Other options (not illustrated) for allowing the two tubes to move relative to each other while dissipating energy include layers of adhesives between the interior and exterior tubes. In this embodiment, the exterior of the interior tube may be slightly larger than the interior of the exterior tube so that friction also inhibits relative movement between the two tubes and locks the tubes together. The adhesive may be selected to increase the resistance to movement between the interior and exterior tubes.

A further option is tack welds which break when a tensile force higher than a limit is applied between the two tubes. In this case when the dynamic event ends the tubes are retained together by the friction between the interior and exterior tubes. Again in this embodiment, the exterior of the interior tube may be slightly larger than the interior of the exterior tube, to increase that friction. The tubes may have a combination of mating deformations including corrugations and one or more of the other options discussed above.

Figure 23:
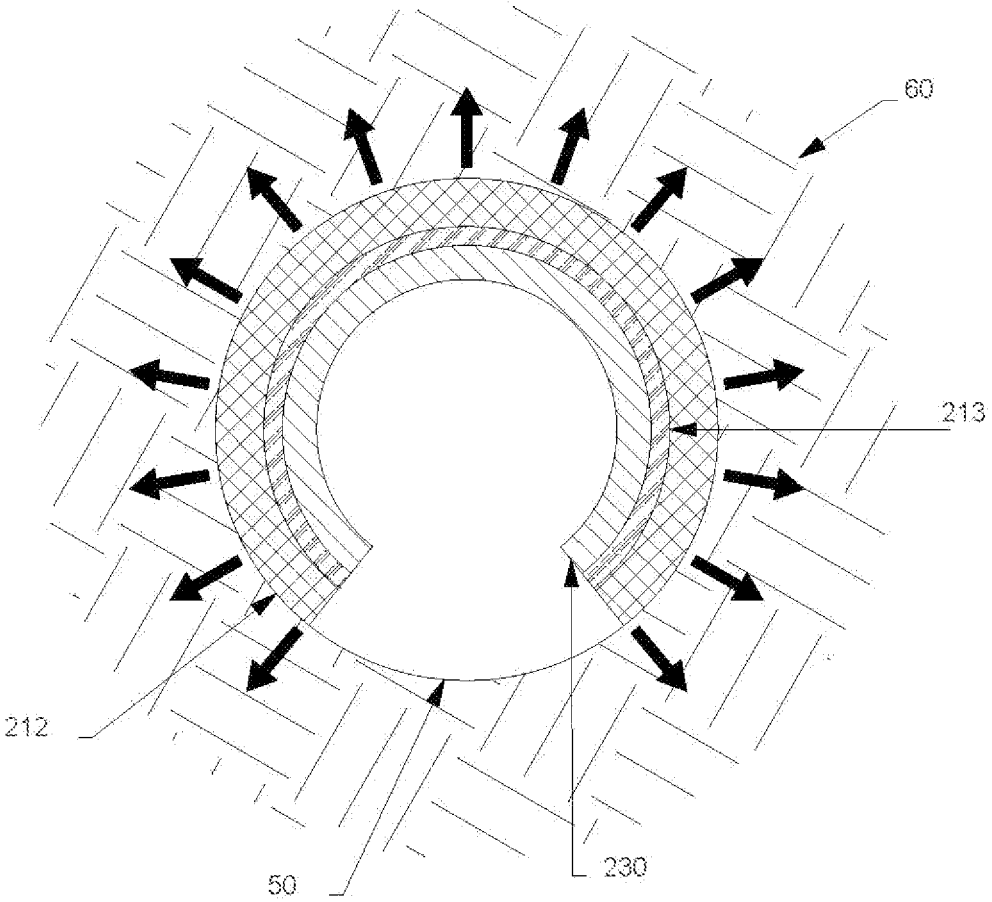
FIG. 23 shows a third embodiment of a friction bolt.

FIG. 23 is a sectional view illustrating a third embodiment of the friction bolt 210 in which the slip and lock mechanism between the inner tube 230 and outer tube 212 is provided by a layer of adhesive 213. Pressure caused by the insertion of the friction bolt 210 into a bore hole 50 which is smaller than the outside diameter of the exterior tube 212 of the friction bolt elastically compresses the tube and causes radial pressure on the walls of the bore indicated by the arrows creating frictional resistance to removal of the fiction bolt 10.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A friction bolt comprising a first elongate tube having an internal diameter and defining a longitudinal split, the tube being radially expandable, the bolt having a first leading or distal end for insertion into a bore and a second or proximal end defining a head and further comprising a second elongate tube defining a longitudinal split and having an external diameter which is substantially the same as or larger than the internal diameter of the first tube located inside the first tube with its exterior in contact with the interior of the first tube and wherein the bolt comprises a slip and lock mechanism that allows the first or exterior and second or interior tubes to move relative to each other along the longitudinal axis of the friction bolt when a tensile force is applied to the bolt, but to lock together after the force is removed, wherein the slip and lock mechanism comprises formations or deformations on one or both of the first and second tubes which interlock the tubes together but which can disengage and allow the tubes to slide relative to one another under longitudinal tension.

2. The friction bolt as claimed in claim 1, wherein the first and second tubes are generally part-circular in cross section.

3. The friction bolt as claimed in claim 1, wherein the first elongate tube has a length and wherein the second elongate tube has a length which is at least half the length of the first elongate tube.

4. The friction bolt as claimed in claim 1, wherein the length of the second elongate tube is substantially the same as the length of the first elongate tube.

5. The friction bolt as claimed in claim 1, wherein the formations or deformations on one or both of the first and second tubes comprise overlapping radial crimps or corrugations on the first and second tubes, the corrugations defining a series of ribs and grooves with the ribs of the corrugations of the first tube nesting in the grooves of the corrugations of the second tube.

6. The friction bolt as claimed in claim 5, wherein the corrugations of the second tube extend further along the tube than the corrugations of the first tube so that they are overlapped by both a corrugated section of the first tube and an un-corrugated part cylindrical section defining a smooth outer surface.

7. The friction bolt as claimed in claim 5, wherein the first and second tubes define at least two overlapping corrugated sections, one near or towards the proximal end of the friction bolt and one near or towards the distal end of the friction bolt.

8. The friction bolt as claimed in claim 1, wherein the proximal end which engages with a bearing plate or the like is defined on one tube and the distal tapered end of the friction bolt is defined on the other tube.

9. The friction bolt as claimed in claim 1, wherein the proximal end of the second tube defines a ring for engagement with a bearing plate or the like and the distal end of the first tube is tapered for insertion into a bore.

10. The friction bolt as claimed in claim 1, wherein the formations on one or both of the first and second tubes comprise overlapping spaced ribs formed on the first and second tubes, the ribs of the first tube nesting in spaces between the ribs of the second tube.

11. The friction bolt as claimed in claim 10, wherein the ribs are formed on the exterior of the second tube by welding or other additive manufacturing process and the ribs are formed on the interior of the first tube by welding or other additive manufacturing process.

12. The friction bolt as claimed in claim 10, wherein the ribs are separated by spaces which are from 1 to 5 times the diameter of the ribs.

13. The friction bolt as claimed in claim 10, wherein there is at least one set of ribs on each tube.

14. The friction bolt as claimed in claim 13, wherein each set of ribs comprises from 2 to 10 ribs.

15. The friction bolt as claimed in claim 1, wherein the slip and lock mechanism comprises a layer of adhesive.

* * * * *